United States Patent [19]

Palmer et al.

[11] 3,983,612

[45] Oct. 5, 1976

[54] METHOD OF INSERTING AN APERTURE MASK SUPPORT PIN INTO A VIEWING PANEL FOR A CATHODE RAY TUBE

[75] Inventors: Wilbur C. Palmer, Corning; Richard L. Seely, Horseheads, both of N.Y.

[73] Assignee: Corning Glass Works, Corning, N.Y.

[22] Filed: Dec. 5, 1974

[21] Appl. No.: 529,600

[52] U.S. Cl. ..... 29/25.15; 29/25.13; 65/154

[51] Int. Cl.[2] ..... H01J 9/18

[58] Field of Search ..... 29/25.13, 25.15, 25.16, 29/25.19, 25.2; 316/25, 14; 313/174, 178, 482, 217, 244, 248, 283; 65/59, 139, 154, 155, DIG. 4; 164/51

[56] References Cited

UNITED STATES PATENTS

| | | | |
|---|---|---|---|
| 3,381,347 | 5/1968 | Reinwall | 29/25.13 |
| 3,461,523 | 8/1969 | Peehs et al. | 29/25.13 |
| 3,493,358 | 2/1970 | Carstensen et al. | 65/154 |
| 3,497,339 | 2/1970 | Eastus | 65/154 X |
| 3,558,961 | 1/1971 | Palsha | 313/174 |
| 3,598,168 | 8/1971 | Clark | 164/51 |
| 3,632,327 | 1/1972 | Matoba et al. | 65/139 X |
| 3,695,860 | 10/1972 | Katuta | 65/154 |

*Primary Examiner*—C.W. Lanham
*Assistant Examiner*—James R. Duzan
*Attorney, Agent, or Firm*—Charles W. Gregg; Burton R. Turner; Clarence R. Patty, Jr.

[57] ABSTRACT

A method of inserting and sealing an end of an aperture mask support pin into the glass of a viewing panel for a cathode ray or television picture tube by heating the pin to the softening point temperature of the glass by use of a substantially flat or pancake type high frequency induction coil and an associated iron core. The iron core may be enclosed in a leak-proof jacket for supplying a coolant to the core for cooling thereof.

16 Claims, 6 Drawing Figures

METHOD OF INSERTING AN APERTURE MASK SUPPORT PIN INTO A VIEWING PANEL FOR A CATHODE RAY TUBE

BACKGROUND OF THE INVENTION

The heating of metallic materials by the use of high frequency induction coils is relatively well known and is, for example, relatively well covered in a book by D. Warburton-Brown, entitled Induction Heating Practice and published in 1956 by Philosophical Library, Inc., 15 East 40th Street, New York, New York. There is also disclosed in U.S. Pat. No. 3,558,961, issued Jan. 26, 1971 to Edward M. Palsha an improved assembly for maintaining a getter container holding a getter material in the interior of a funnel portion of an electron tube, such as a television picture tube, and the flashing of such getter material by the use of an R-F or high frequency induction heating coil positioned near the outer wall of the funnel portion of said tube, such coil having somewhat of a configuration of a so-called pancake type high frequency induction heating coil. However, insofar as is known, a pancake type or substantially flat spiraled induction heating coil having an associated iron core for concentration of magnetic flux, has not, as disclosed in the present application, heretofore been used for induction heating of an aperture mask support pin for insertion of an end of such pin a desired distance into the glass of a viewing panel for a cathode ray or television picture tube, such coil being disposed for said heating purposes, adjacent to the glass viewing panel surface opposite to the glass surface of the viewing panel into which said end of the pin is to be inserted. It is, accordingly, an object of the present invention to provide a new method of inserting an end of an aperture mask support pin into the glass of a viewing panel for a cathode ray or television picture tube.

Other objects and characteristic features of the invention will become apparent as the description proceeds.

SUMMARY OF THE INVENTION

The invention is believed to be adequately summarized in the foregoing abstract of the disclosure and, therefore, to prevent repetition or redundancy and for the purpose of brevity to the extent possible, no additional summary of the invention is considered necessary nor will be given.

BRIEF DESCRIPTION OF THE DRAWINGS

In the drawings.

Similar reference characters refer to similar parts in each of the Figs. of the drawings.

Preferred Embodiments of the Invention

Figure 1:
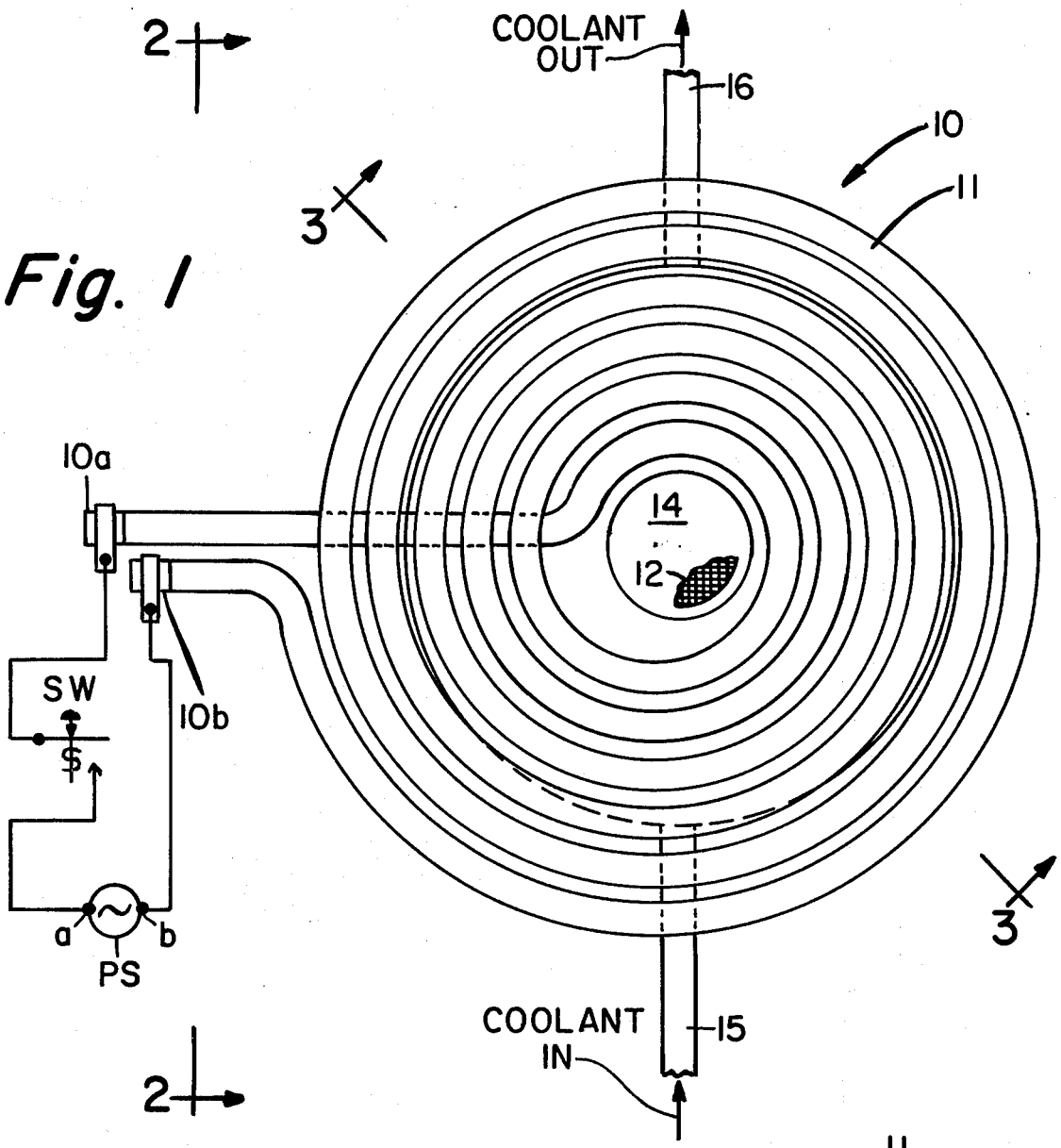
FIG. 1 is a top plan view of an induction coil and associated parts used in practicing the invention disclosed and including a simple schematic wiring diagram illustrating a circuit for connecting the coil across the terminals of a high frequency alternating current source.
Figure 2:
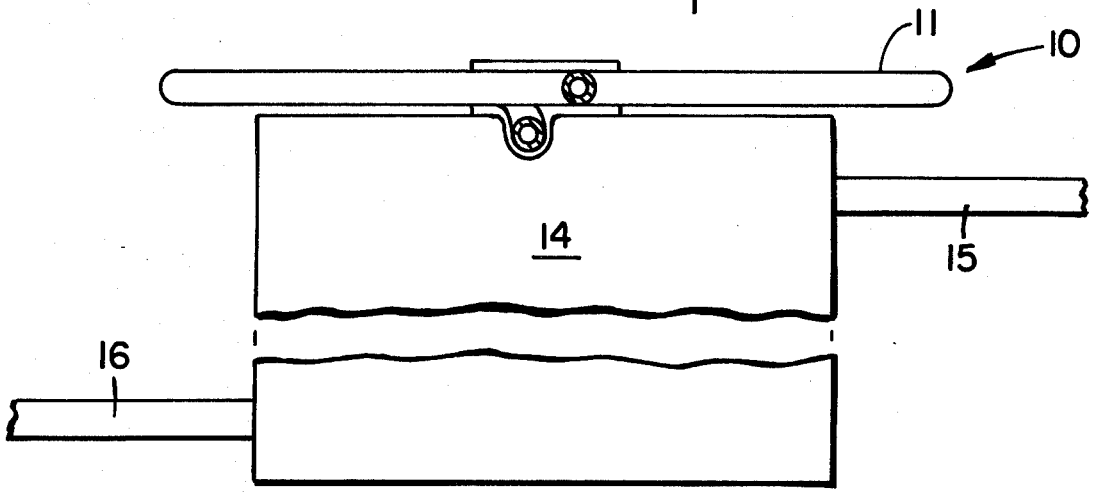
FIG. 2 comprises an elevational view of the coil and associated parts illustrated in FIG. 1, such view being taken generally along line 2—2 of FIG. 1.
Figure 3:
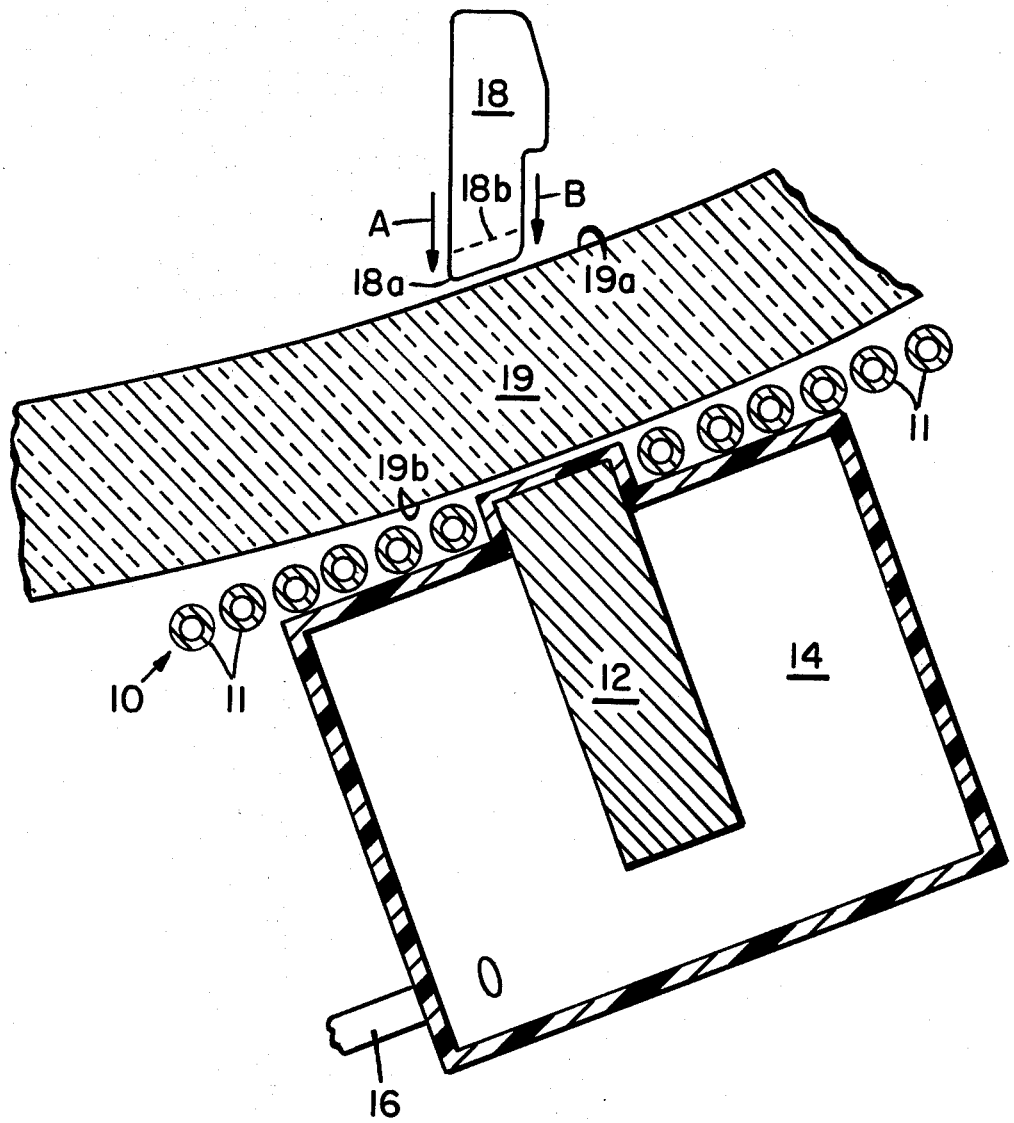
FIG. 3 is a cross-sectional view of the coil and associated parts illustrated in FIG. 1, such view being taken generally along line 3—3 of FIG. 1 and schematically illustrating the positioning of the coil and an aperture mask support pin adjacent a section of a viewing panel for heating and inserting such pin in the glass of such panel.

Referring to FIGS. 1 through 3 of the drawings in detail, there is shown a high frequency induction coil 10 formed, for example, from electrically insulated copper tubing 11 which is wound in a flat spiral configuration to make a so-called pancake type induction coil. As illustrated in FIG. 3, one end of an elongate iron core 12 is inserted in the center or central turn of coil 10, that is to say, the center turn of coil 10 surrounds core 12 adjacent one end thereof. Core 12 is preferably surrounded by a leak proof hollow jacket 14 of a plastic material, such as TEFLON for example, such jacket having fluid inlet and outlet conduits 15 and 16, respectively, connecting with the interior of the jacket and by which a supply or flow of a coolant, such as water for example, can be supplied to said interior and about core 12 for cooling thereof when coil 10 is energized as hereinafter discussed.

In practicing the invention disclosed, an aperture mask support pin 18, as illustrated in FIG. 3, disposed with its glass insertion end **18*a* adjacent a location on the surface 19*a* of a viewing panel 19 for a cathode ray or television picture tube, such location being that at which it is desired to insert end 18*a* of pin 18 into the glass of the viewing panel. Pin 18 may be so disposed in any convenient manner as by a suitable chuck or any other means suitable for holding the pin and applying forceful movement thereto in the direction of the arrows A and B shown in FIG. 3. Dotted line 18*b* shown on pin 18 gives an example of the distance to which such pin is to be inserted into the glass of panel 19**.

The pancake type high frequency induction coil 10 is disposed adjacent surface **19*b* of panel 19 at a location on such surface such that the center of the coil is substantially precisely opposite said location on surface 19*a* at which pin 18 is to be inserted into the glass of the panel. That is to say, coil 10 is disposed as stated so that the opening in the center or central turn of the coil is substantially precisely opposite said location on surface 19*a***.

Said one end of iron core 12, with or without jacket 14 is disposed in said center or central turn of coil 10 with the face of such one end being disposed adjacent said location on surface **19*b* of panel 19. If jacket 14 is employed, a supply or flow of coolant such as water from a suitable source is supplied through conduit 15 to the interior of jacket 14 and about the periphery of core 12, such coolant flowing through said interior and out conduit 16 to a suitable fluid sink as indicated in FIG. 1**. Such sink and the aforementioned source of coolant are not shown in the drawings for purposes of simplification thereof.

As further illustrated in FIG. 1, the insulation is removed from one end **10*a* of coil 10** and such end is electrically connected to one side of an electric switch SW shown as a spring-return push type switch which is manually operable or depressed for closing of a circuit through the switch and is spring return to open to interrupt such circuit when the switch is no longer manually actuated or depressed. The second side of switch SW is connected to one terminal *a* of a high frequency source PS of alternating current suitable for energizing coil 10 as is well known in the art. The insulation is also removed from the second end 10*b* of coil 10 and terminal *b* of source PS is electrically connected directly to such end 10*b* of coil 10.

With the apparatus and the parts such as pin 18 and viewing panel 19 arranged as described above, and as shown in FIG. 3, switch SW is actuated closed to electrically connect the ends 10*a* and 10*b* of coil 10 across the high frequency current source PS and such coil then produces lines of magnetic flux which extend up through the glass of panel 19 to heat pin 18 in the manner well known in the art of electrical induction heating. Iron core 12 is used to increase flux concentration towards pin 18 for resultant increased heating of such pin. When pin 18 is sufficiently heated, that is, when pin 18 reaches a temperature above the softening point temperature of the glass of panel 19, the pin is actuated in the direction of arrows A and B (FIG. 13) and the glass of the panel becomes softened by the heat of the pin to permit end 18*a* of the pin to be inserted into such glass.

As the insertion of end 18*a* of pin 18 into the glass of panel 19 progresses, such end approaches more closely to core 12 and coil 10 and the heat of the pin increases. Therefore, to prevent possible excessive heating and resultant burning of pin 18 and possible resultant undue softening of the glass of panel 19, the output of power source PS, when it is found to be expedient or necessary to do so, may be decreased in any of the manners well known in the art of induction heating to decrease the heating of the pin as its movement or insertion into the glass progresses. When end 18*a* of pin 18 has been inserted to the desired depth into the glass of panel 19, such as to the depth indicated by the dotted line 18*b* on pin 18, switch SW is released or no longer actuated and the spring return feature of the switch actuates the switch open to interrupt the current to coil 10. The pin and panel are then permitted to cool to seal end 18*b* of the pin in the glass of panel 19. The chuck or other means used for holding pin 18 and urging the heated pin into the glass of panel 19 is actuated to release the pin following sufficient cooling and sealing thereof in said glass.

Figure 4:
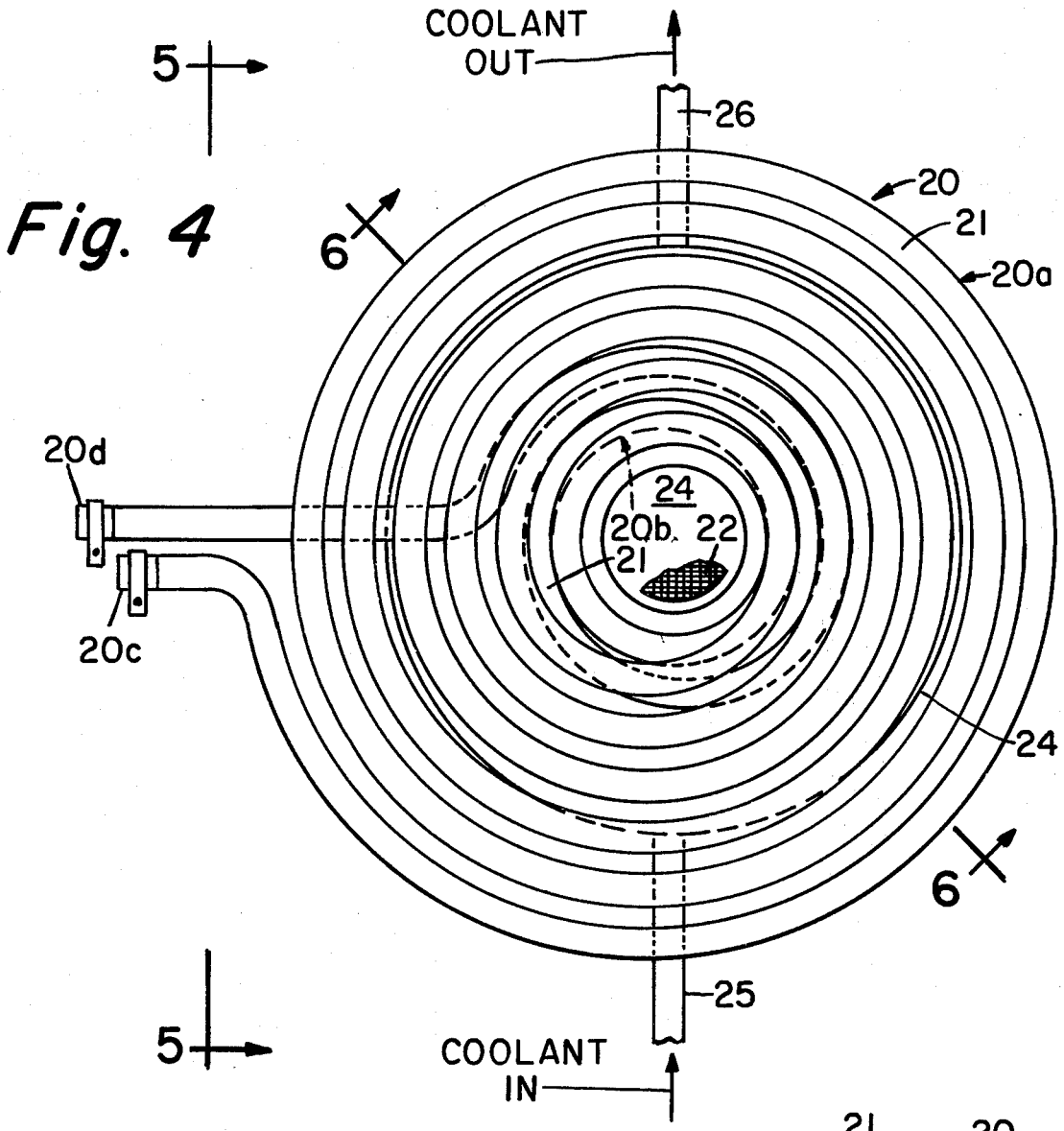
FIG. 4 is a view similar to FIG. 1 illustrating a modification of the induction coil used in practicing the invention and omitting the schematic wiring diagram of the circuit for energizing the coil.
Figure 5:
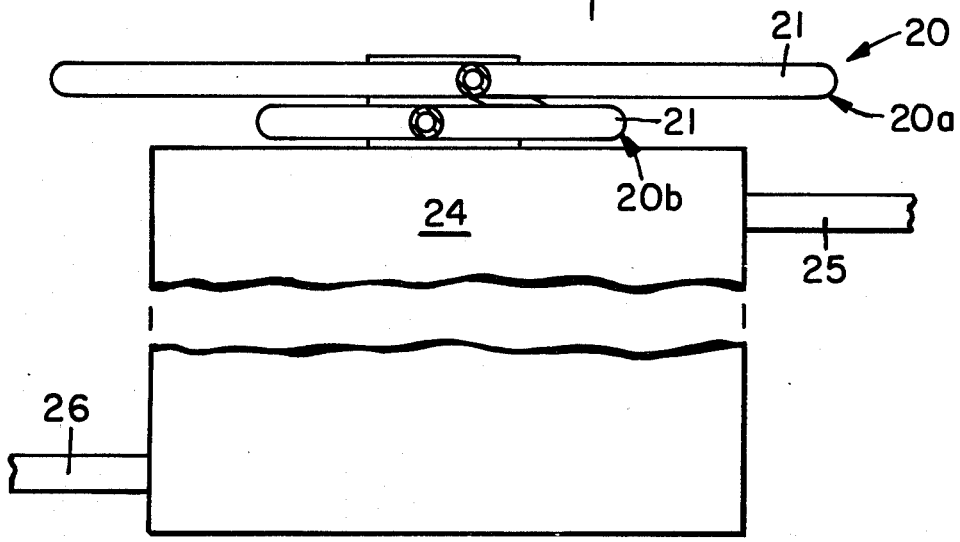
FIG. 5 is an elevational view of the coil and associated parts shown in FIG. 4, such view being taken generally along line 4—4 of FIG. 4.
Figure 6:
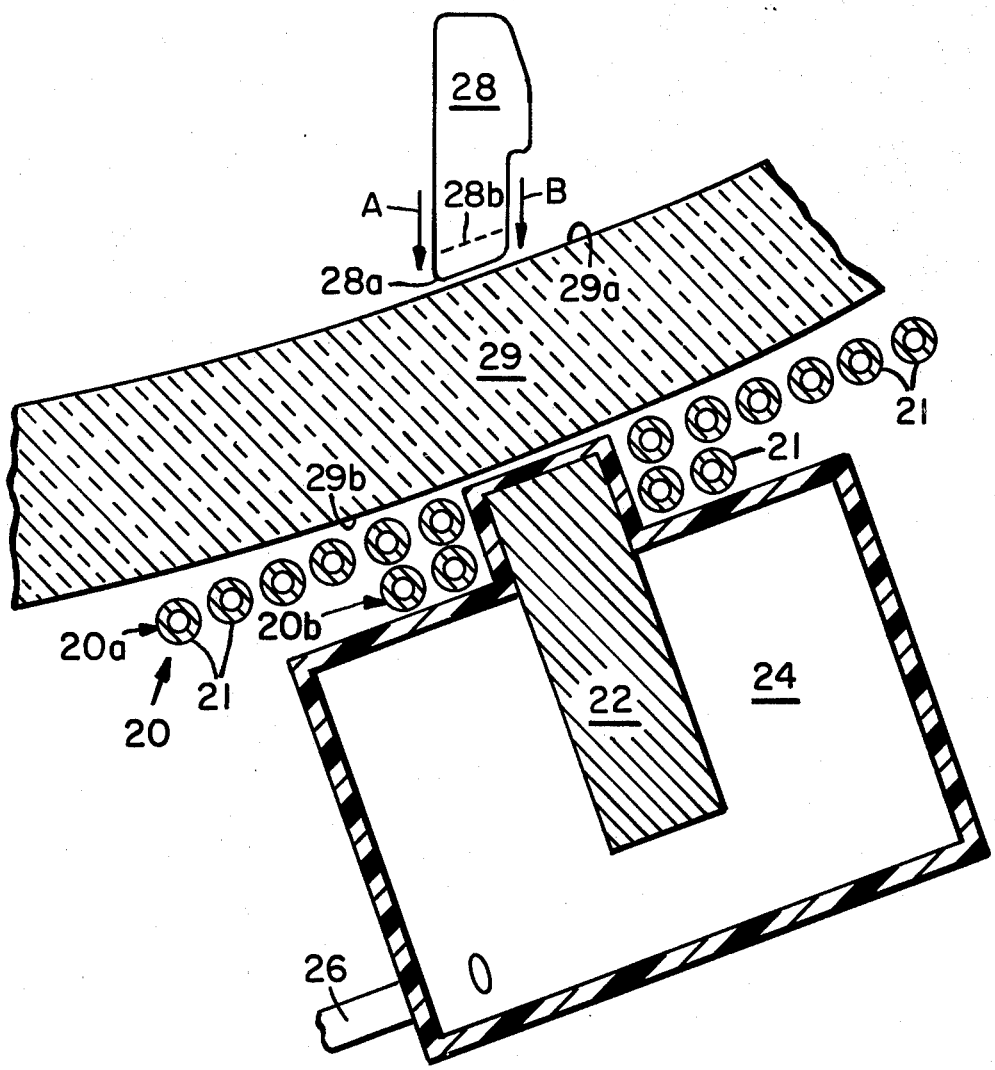
FIG. 6 is a cross-sectional view of the coil and associated parts illustrated in FIG. 4, such view being similar to FIG. 3 but taken generally along line 6—6 of FIG. 4.

Referring now to FIGS. 4 through 6 of the drawings in detail, there is shown a two-tier or stacked high frequency induction coil 20 including an upper coil tier 20*a* similar to coil 10 of FIGS. 1 through 3 and a lower coil tier 20*b* of a lesser number of turns than coil tier 20*a*. Coil tiers 20*a* and 20*b* are wound from a single continuous length of electrically insulated copper tubing 21 with the turns of tier 20*b* being a continuation of the turns of tier 20*a* wound in a different plane as best illustrated in FIGS. 4 and 5. In other words the coil 20 of FIGS. 4 through 6 is a modified type of pancake coil. As illustrated in FIG. 6, one end of an elongate iron core 22 is inserted in the center or central turn of coil tiers 20*a* and 20*b*, that is to say, the center turn of coil tiers 20*a* and 20*b* surround core 22 adjacent one end thereof. Core 22 is surrounded by a leak proof hollow jacket 24 of a plastic material, such as TEFLON, such jacket having fluid inlet and outlet conduits 25 and 26, respectively, connecting with the interior of the jacket and by which a supply or flow of a coolant, such as water, can be supplied to said interior and about core 22 for cooling thereof when coil 20 is energized as hereinafter discussed.

In practicing the modification of the invention disclosed, an aperture mask support pin 28 is, as illustrated in FIG. 3, disposed with its glass insertion end 28*a* adjacent a location on the surface 29*a* of a viewing panel 29 for a cathode ray or television picture tube, such location being that at which it is desired to insert end 28*a* of pin 28 into the glass of the viewing panel. Pin 28 may be so disposed in any convenient manner as by a suitable chuck or any other means suitable for holding the pin and applying forceful movement thereto in the direction of the arrows A and B shown in FIG. 6. Dotted line 28*b* shown on pin 28 gives an example of the distance to which such pin is to be inserted into the glass of panel 29.

The stacked pancake type high frequency induction coil 20 comprising tiers 20*a* and 20*b* is disposed adjacent surface 29*b* of panel 29 at a location on such surface such that the center of the coil is substantially precisely opposite said location on surface 29*a* at which pin 28 is to be inserted into the glass of the panel. That is to say, the stacked coil 20 is disposed as stated so that the opening in the center or central turns of the coil tiers 20*a* and 20*b* are substantially precisely opposite said location on surface 29*a*.

Said one end of iron core 22, with or without jacket 24 is disposed in said center or central turns of core tiers 20*a* and 20*b* with the face of such one end being disposed adjacent said location on surface 29*b* of panel 29. If jacket 24 is employed, a supply or flow of coolant such as water from a suitable source is supplied through conduit 25 to the interior of jacket 24 and about the periphery of core 22, such coolant flowing through said interior and out conduit 26 to a suitable fluid sink as indicated in FIG. 4. Such sink and the aforementioned source of coolant are also not shown in the drawings for purposes of simplification thereof.

In employing the modification of the invention shown in FIGS. 3 through 6, the insulation is removed from the ends 20*c* and 20*d* of coil tiers 20*a* and 20*b*, respectively, and the stacked pancake type of coil is energized in a manner similar to that described for coil 10 in conjunction with FIGS. 1 through 3 of the drawings. The description of the use of the induction coil of FIGS. 1 through 3 is also equally applicable to the modification of the invention illustrated in FIGS. 4 through 6 and no further detailed description thereof is believed necessary.

It is pointed out that a coolant can also be circulated through the copper tubing 11 of coil 10 or copper tubing 21 of coil 20 for cooling thereof if it is found desirable or necessary to do so. It is also expedient to point out that, since the copper tubings 11 and 21 are electrically insulated such tubings as well as the face of the end of core 12 (or core 22) surrounded by such tubings could be disposed in contact with the glass of surface 19*b* of panel 19 (or surface 29*b* of panel 29) rather than slightly spaced therefrom as shown in FIGS. 3 and 6. Therefore, the term "adjacent" as used herein is intended to mean either in contact or in near contact in accordance with an accepted meaning for such term.

It is also believed expedient to point out that pins 18 and 28 are each shown as a new type of aperture mask support pin, such a pin being disclosed and claimed in copending application Ser. No. 526,138, filed Nov. 22, 1974, now U.S. Pat. No. 3,952,551, by Wilbur C. Palmer and Richard L. Seely and such application being assigned to the same assignee as the present application.

Although there is herein illustrated and described only two examples of practicing the method disclosed, it will be understood that such is not to be considered in any way limiting but that various changes and modifications in the practice of such method may be made within the purview of the appended claims without departing from the spirit and scope of the invention.

What is claimed is:

1. The method of inserting and sealing an end of an aperture mask support pin in the glass of a viewing panel for a cathode ray tube, such method comprising;

A. disposing said end of said pin adjacent one surface of said panel in the location of such surface at which it is desired to insert such end of the pin into the glass of such panel;

B. disposing one end of an elongate iron core adjacent the second surface of said panel at a location on such surface substantially precisely opposite said location on said one surface of such panel;

C. surrounding the outer periphery of said core adjacent said one end thereof with a high frequency induction coil having a substantially flat spiral configuration;

D. supplying high frequency alternating current to the ends of said coil to inductively heat said pin to above the softening point temperature of the glass of said panel and, following such heating, inserting said end of said pin into such glass to a preselected depth; and F. thereafter terminating said supply of current to permit said pin and glass to cool to seal said inserted end of said pin in such glass.

2. The method in accordance with claim 1 and in which said core is surrounded by a leak-proof hollow plastic jacket and including the further step of supplying a flow of coolant to the interior of such jacket for cooling of such core.

3. The method in accordance with claim 1 and in which the amperage of said high frequency current is reduced as said pin progresses into said glass during said insertion of such pin.

4. The method in accordance with claim 2 and in which the amperage of said high frequency current is reduced as said pin progresses into said glass during said insertion of such pin.

5. The method in accordance with claim 1 and in which said induction coil is a two tier coil formed of a continuous single length of copper tubing.

6. The method in accordance with claim 2 and in which said induction coil is a two tier coil formed of a continuous single length of copper tubing.

7. The method in accordance with claim 3 and in which said induction coil is a two tier coil formed of a continuous single length of copper tubing.

8. The method in accordance with claim 4 and in which said induction coil is a two tier coil formed of a continuous single length of copper tubing.

9. The method of inserting and sealing an end of an aperture mask support pin into the glass of a viewing panel for a color television picture tube, such method comprising;

A. disposing a pancake type high frequency induction coil adjacent one surface of the glass of said panel in a location thereon opposite a location on the opposite surface of such glass at which said end of said pin is to be inserted into the glass;

B. disposing one end of an elongate iron core in the center turn of said coil with the face of such end adjacent said one surface of said glass of said panel at said location thereon;

C. disposing said pin with said end thereof adjacent said location on said opposite surface of said glass of said panel;

D. supplying high frequency alternating current to said coil to generate lines of magnetic flux for induction heating of said pin, said iron core increasing flux concentration for increased heating of said pin; and E. after sufficient heating of said pin, inserting said end of such pin into said glass of said panel to a desired depth and then terminating said supply of current to said coil for sealing such end of the pin in the glass.

10. The method in accordance with claim 9 and in which said core is surrounded by a leak-proof hollow plastic jacket and including the further step of supplying a flow of coolant to the interior of such jacket for cooling of such core.

11. The method in accordance with claim 9 and in which the amperage of said high frequency curent is reduced as said pin progresses into said glass during said insertion of such pin.

12. The method in accordance with claim 10 and in which the amperage of said high frequency current is reduced as said pin progresses into said glass during said insertion of such pin.

13. The method in accordance with claim 9 and in which said induction coil is a two tier coil formed of a continuous single length of copper tubing.

14. The method in accordance with claim 10 and in which said induction coil is a two tier coil formed of a continuous single length of copper tubing.

15. The method in accordance with claim 11 and in which said induction coil is a two tier coil formed of a continuous single length of copper tubing.

16. The method in accordance with claim 12 and in which said induction coil is a two tier coil formed of a continuous single length of copper tubing.

* * * * *